United States Patent [19]

Montgomery

[11] Patent Number: 4,508,617

[45] Date of Patent: Apr. 2, 1985

[54] DETECTION OF CATALYST BY-PASSING IN FIXED BED NAPHTHA REFORMER

[75] Inventor: Dean P. Montgomery, Bartlesville, Okla.

[73] Assignee: Phillips Petroleum Company, Bartlesville, Okla.

[21] Appl. No.: 611,654

[22] Filed: May 18, 1984

[51] Int. Cl.[3] ..... C10G 35/04

[52] U.S. Cl. ..... 208/134

[58] Field of Search ..... 208/134, 135, 138

[56] References Cited

U.S. PATENT DOCUMENTS 2,485,073 10/1949 Shiffler et al. .
2,642,383 6/1953 Berger et al. .
2,654,694 10/1953 Berger et al. .
2,863,826 12/1958 Holcomb et al. .
3,000,812 9/1961 Boyd, Jr. .
3,914,171 10/1975 Schoennagel .
4,033,727 7/1977 Vautrain .

*Primary Examiner*—Curtis R. Davis
*Attorney, Agent, or Firm*—Lyell H. Carver

[57] ABSTRACT

In a normally endothermic naphtha reformer reactor, using a fixed bed of particulate catalyst, to determine if catalyst by-passing is occurring, the feed rate to the reactor is decreased, e.g., by such as about 30 percent, to a rate found previously still to produce an endothermic reaction. If the reactor outlet temperature now exceeds the reactor inlet temperature, the reaction is exothermic, and catalyst by-passing is occurring.

15 Claims, No Drawings

DETECTION OF CATALYST BY-PASSING IN FIXED BED NAPHTHA REFORMER

FIELD OF THE INVENTION

The invention pertains to naphtha reforming processes. In a particular aspect, the invention pertains to the maintenance of endothermic naphtha reforming reactions. In a related aspect, the invention pertains to the detection of catalyst by-passing or channeling in naphtha reforming catalyst beds. In a particular aspect, the invention pertains to the detection of channeling in fixed bed reformers.

BACKGROUND OF THE INVENTION

Catalytic reforming of naphtha streams is one method of increasing the anti-knock quality of straight run and naphtha-gasolines so as to obtain blending stocks for the production of relatively high octane motor fuels, and also is employed for the production of benzene, xylenes, and toluene (BTX).

Typically, in the reforming of gasoline base stocks, a straight run or other gasoline fraction which may have an octane number of such as between about 30 and 60 is contacted in admixture with hydrogen with a suitable reforming catalyst at temperatures such as about 800° to 1000° F. and pressures between about 50 and 500 psi, producing a product having a research octane number with 3 cc TEL (tetraethyllead) (RON) of between about 85 and 110 and having improved characteristics for use as a motor fuel or as a petrochemical source.

The improvement effected in the gasoline base stock results from a number of reactions which include dehydrogenation of naphthenes to produce aromatics, cyclization of straight-chain hydrocarbons to produce cyclic hydrocarbons, hydrocracking of larger molecules to produce smaller molecules, isomerization of straight-chain molecules to produce branched chain molecules, and so on.

In a reformer, temperature control is essential. The reforming operation is endothermic. Thus, the feed thereto must be preheated. Higher temperature feedstock input tends to produce greater conversion and higher octane numbers of the product. Generally, the heat input is ultimately controlled by the octane rating characteristics of the reformer output.

Unfortunately, the process is difficult to control from many aspects.

In the reforming process, the various described reactions in sum effectively result in a net endothermic reaction manifested by temperature drop across the reforming reactors. Several in-series reactors commonly are utilized, with inter-reactor heating. The amount of summed temperature drops across the reactor or reactors is an indication of the extent of the reactions, therefore an indication of the composition of the product. Observed temperature drops diminish in the successive reactors, becoming nearly zero across the last reactor. Observation of the overall temperature drop (summed temperature drop), coupled with observation of the octane number reached in product stream, is used to control the heat applied to the feed stream. Usually, all reactors are controlled by feed stream heating to have the same inlet temperature, although some refiners practice ascending inlet temperatures.

Complicating the situation, however, is the tendency for the reforming particulate catalyst beds to develop channels, or settle leaving free-board, upsetting considerably the balancing or residence time of the reactions, inlet feed temperatures, quality of the output, and so on. More particularly, if a portion of the fluid flow by-passes the catalyst, or if channels develop within the bed thus permitting feed stock to by-pass the catalyst, flow rates in the normal portion of the bed will be reduced. Thus, some of the feed stock inadequately contacts the catalyst, but the short-circuiting means that other portions of the feed stock contact the catalyst particles for too long a time. At sufficiently low flow values, hydrocracking may become excessive, and the liquid product is of relatively low value for the experienced inlet temperatures.

It is challenging to find a way to be able to detect catalyst by-passing without visual inspection of the bed, which of course is simply impractical from the down time and labor involved.

BRIEF SUMMARY OF THE INVENTION

I have discovered that in the normally endothermic reforming of naphtha streams, that catalyst by-passing, such as channeling can be detected upon change of the mass flow by deliberately reducing the inlet feedstream feed rate. If an exotherm then develops at what previously was a satisfactory reduced feed rate, this exotherm indicates a condition of malflow in the reactor bed.

More particularly, in a normally endothermic naphtha reformer reactor, using a fixed bed of catalyst, in order to determine if channeling is occurring or has occurred, the feed rate to the reactor is decreased, by about such as 20 to 40, preferably about 30 volume percent, and if the reactor outlet stream temperature changes to exceed the reactor inlet feed stream temperature, catalyst by-passing is occurring, provided that at an earlier testing at the same reduced rate no such exotherm became evident.

More particularly, in accordance with my invention, the initial lined-out temperature of the naphtha reformer outlet stream is compared with the inlet stream temperature, and the $\Delta T$ determined, when the reactor is placed on stream with fresh catalyst. The $\Delta T$ normally should be negative, since the proper balance of reactions in the naphtha reforming reactor employing a fixed catalytic bed is endothermic. The inlet flow rate is reduced, and the rate determined which just reflects a zero or barely positive $\Delta T$. This is used as a base line. Then, to determine by-passing during regular operation, the inlet flow rate is again reduced to about the same base line level. Upon such reduced feed inlet flow rate the $\Delta T$ then becomes positive, this now-positive $\Delta T$ indicates an exothermic balance of reactions, that hydrocracking has become predominant, and indicates that catalyst by-passing is occurring. Most frequently this occurs in the final reactor of a series. Hydrocracking also will be evidenced by reduced yields of hydrogen and increased yields of light hydrocarbons (methane and ethane).

It is an object of my invention to provide a method whereby channeling can be detected in a fixed bed naptha reforming reactor.

Suitable reforming catalysts include noble metal catalysts, particularly platinum-containing catalysts. Bimetallic and multi-metallic catalysts are useful, such as those disclosed in various U.S. patents including U.S. Pat. No. 3,957,688, U.S. Pat. No. 3,894,110, U.S. Pat. No. 3,844,935, U.S. Pat. No. 3,679,578, U.S. Pat. No.

3,578,582, U.S. Pat. No. 3,558,477, U.S. Pat. No. 3,434,960, and U.S. Pat. No. 3,415,737. Platinum-rhenium on alumina, platinum-iridium-gold on alumina, are examples. Water and/or halogens, or halogen-containing compounds such as hydrogen chloride, frequently are used to provide control of catalyst acidity, which in turn affects isomerization (desired) and hydrocracking (usually undesired).

Suitble feed stocks for motor fuel production comprise straight run and/or cracked naphthas boiling in the range of about 120° F. to 400° F. Such streams include hydrocarbons in the ranges of about 35 to 70 volume percent paraffins, 5 to 25 volume percent aromatics, and 10 to 45 volume percent naphthenics. For the production of aromatics or aviation gasolines, straight run naphtha fractions frequently are preferred. Hydrogen rich gases are used in conjunction with the reforming operation, and, being produced in the process, are separated and recycled as desired or needed. A preferred feed stock entering the reactor in a catalytic reforming system presently preferably should contain about 40 to 50 volume percent naphthenes and 5 to 10 volume percent aromatics, the remainder being normal and isoparaffinic hydrocarbons.

In catalytic reforming systems, major process variables include suitable and effective temperatures, space velocities, pressures, and hydrogen rates for the catalyst and feed employed.

Several in-series reactors commonly are utilized, with inter-reactor heating. These reactors generally are successively larger, having typical volume ratios of such as 1, 1.5, 3, and 5.

Broadly, the reforming reactors can operate in the range of inlet reactor temperatures of about 800° F. to 1000° F.; the outlet reactor temperatures can operate in the range of about 700° to 1000° F.; thus, a broad range of negative delta temperatures ($\Delta T$'s) is possible. The largest $\Delta T$ is found in the first reactor, and the summed $\Delta T$'s can be as great as −400° F., but are most usually about −100° F. to −300° F., that is the arithmetic addition of the $\Delta T$ values for each reactor means. Preferably, the inlet temperature to the reformer reactors is on the order of about 850° to 950° F. and normal product stream exit temperature is on the order of about 700° to 950° F. Presently preferred conditions include pressures of about 50 to 500 psig with a hydrogen rate of about 2000 to 5000 SCF/Bbl of feed. Broadly, the liquid hourly space velocity, Bbl charge/Bbl catalyst/hr, can range from about 0.7 to 3, preferably about 1.2 to 2.5. Broadly, the hydrogen/naphtha molar ratio ($H_2$/HC), (Hydrogen/Hydrocarbon) can range from about 2 to 8, preferably about 3 to 6, mols/mol. Broadly, the reactors pressures can range from about 50 to 500, usually about 150 to 475, psig. Lower pressures favor the desired reactions, but also favor the formation of catalytic coke which tends to deactivate the catalyst over a relatively long period. Such a period is called the cycle time, and resistance to coke deactivation is denoted as catalyst stability. Normally, the coke-caused deactivation within a cycle is offset by raising reactor inlet temperatures until these temperatures reach a limit imposed by, e.g. metallurgy, diminished yield of liquid product, or compressor limitations.

To practice the invention, when the catalyst is relatively newly placed and by-passing is not occurring, the limiting low space velocity is determined at which hydrocracking becomes too severe. This will be manifest from unacceptable loss of liquid yield and reduced hydrogen production, a reactor exotherm, accelerated production of light hydrocarbons, and a low yield of high quality liquid product as evidenced by a high octane number and high concentration of aromatics. At later times, hydrocracking caused from by-passing will be manifest if, within the same previously acceptable range of space velocities, hydrocracking is evidenced as above, except that now the liquid product is of relatively poor quality because a significant portion of the feedstock is by-passing the catalyst, yet other portions of the feedstock have been changed to light hydrocarbons by excessive hydrocracking. Thus, if catalyst by-passing is suspected during conditions of normal operation, a deliberate reduction of space velocity to within the previously determined initially acceptable range can be carried out; if hydrocracking develops as just described, and the overall reaction balance then becomes exothermic, a normally properly endothermic reforming reaction has become exothermic under conditions of poor flow distribution, and catalyst by-passing is indeed likely.

EXAMPLES

Examples are provided to assist one skilled in the art to a further knowledge of my invention. Particular streams and conditions should be considered as illustrative, and not limitative, of the scope of my invention.

EXAMPLE I (Illustrative Calculation)

Typical example of feed and product from a naphtha reformer would be as follows:

TABLE I-A

| | Feed | Product Reformate |
|---|---|---|
| Gravity, @ API | 52.1 | 45.8 |
| Reid Vapor Pressure psig | 0.9 | 3.1 |
| ASTM Distillation (14.7 psia) | | |
| Initial Boiling Point °F. | 237 | 113 |
| 10% Vaporized °F. | 250 | 214 |
| 50% Vaporized °F. | 275 | 271 |
| 70% Vaporized °F. | 295 | 294 |
| 90% Vaporized °F. | 335 | 332 |
| End Point °F. | 395 | 411 |
| Material Overhead in Receiver, Vol. % | 98.3 | 98.3 |
| Research Octane No. Clear | (est. 50–60) | 89.4 |
| Research Octane No. + 3 cc TEL | (est. 60–70) | 98.1 |
| Total Sulfur, ppm | 0.32 | 0.0 |
| Paraffins Vol % | 45.7 | 46.3 |
| Olefins Vol % | 0.0 | 0.0 |
| Naphthenes Vol % | 31.4 | 3.1 |
| Aromatics Vol % | 22.9 | 50.6 |

Assume typical conditions of four reforming reactors in series prior to the application of my invention to detect catalyst by-passing within any one of the four reactor beds:

TABLE I-B

| | Reactor No. | | | |
|---|---|---|---|---|
| | 1 | 2 | 3 | 4 |
| Reactor Inlet Temperature °F. | 899 | 899 | 899 | 899 |
| Reactor Outlet Temperature °F. | 814 | 843 | 872 | 876 |
| Reactor Temperature, °F. (average) | 857 | 871 | 886 | 888 |
| Reactor $\Delta T$, °F. | −85 | −56 | −27 | −23 |
| Percent of Total $\Delta T$ | 44.5 | 29.3 | 14.2 | 12.0 |
| Pressure of vessel, psig (inlet) | 407 | 395 | 382 | 370 |
| Total Volume of Catalyst, Bbl (94,340 lbs.) | | | 429.7 | |
| Liquid Hourly Space Velocity, Bbl. Feed/Bbl Cat./Hr(1) | | | 1.49 | |

TABLE I-B-continued

| | Reactor No. | | | |
|---|---|---|---|---|
| | 1 | 2 | 3 | 4 |
| Hydrogen Gas MMSCFD (92.7 mol % $H_2$) | | | | 89.25 |
| $H_2$/HC Mol Ratio | | | | 5.9 |

(1)Bbl. Feed/Bbl Cat/Hr = barrels of feed (charge) as liquid per barrel of catalyst in the reactor per hour.
(2)MMSCFD = Million standard cubic feet per day.

Now reduce the feed rate to 70% of the initial 1.49 space velocity or 1.04 Bbl charge/Barrel of Catalyst/Hr, and expect the following results.

TABLE I-C

| | Reactor No. | | | |
|---|---|---|---|---|
| | 1 | 2 | 3 | 4 |
| Reactor Inlet Temperature °F. | 899 | 899 | 899 | 899 |
| Reactor Outlet Temperature °F. | 814 | 843 | 872 | 908 |
| Reactor Temperature °F. (average) | 857 | 871 | 886 | 904 |
| Reactor ΔT, °F. (temp. drop) | −85 | −56 | −27 | 9 |
| Pressure of Vessel, psig. | 407 | 395 | 382 | 375 |

Such results would indicate that Reactor No. 4 was experiencing hydrocracking since the temperature increased across the reactor from reactions that normally are (overall) endothermic and which normally experiences a temperature drop. Such hydrocracking can be indicative of bed channeling. Thus to detect malflow in commercial reactors a reduced feed rate is used that should not exhibit an exotherm. This test method produces an exotherm by step reduction in space velocity to indicate a condition of malflow in the reactor. This malflow can be either from by-passing a portion by channeling in the bed with the remainder of the feed passing at reduced space velocity through the bed or the reason may be by-passing at the top of the bed to insufficient extra seal catalyst to fill the bed after catalyst shrinkage during use.

EXAMPLE II

Naphtha Reforming Pilot Plant Actual Test Data

A naphtha feed of 51.7 research octane number (clear) was tested in a pilot plant for naphtha reforming having four in-series fixed bed reactors. The naphtha feed had 41 wt % paraffins, 42 wt % naphthenes and 16 wt % aromatics content. Three of the experimental runs are shown in the table below:

TABLE II-A

| | Reactor Temperatures °F. | | |
|---|---|---|---|
| Test | 1 | 2 | 3 |
| LHSV (BBl Feed/BBL Cat./HR) | 1.55 | 0.91 | 0.63 |
| Pressure, psig | 433 | 432 | 430 |
| Reactor 1 | | | |
| In | 886 | 888 | 893 |
| Out | 783 | 798 | 833 |
| ΔT (temp. drop) | −103 | −90 | −60 |
| Reactor 2 | | | |
| In | 888 | 887 | 892 |
| Out | 846 | 859 | 879 |
| ΔT (temp. drop) | −42 | −26 | −13 |
| Reactor 3 | | | |
| In | 889 | 888 | 892 |
| Out | 876 | 880 | 892 |
| ΔT (temp. drop) | −13 | −8 | 0 |
| Reactor 4 | | | |
| In | 889 | 889 | 890 |
| Out | 884 | 888 | 902 |
| ΔT (temp. drop) | −5 | −1 | +12 |

TABLE II-A-continued

| | Reactor Temperatures °F. | | |
|---|---|---|---|
| Test | 1 | 2 | 3 |
| Sum of Total ΔT | −163 | −125 | −61 |

As can be seen, Run 1 was made at a liquid hourly space velocity (LHSV) of about 1.5 $HR^{-1}$ which is typical of commercial reforming operation. In Runs 2 and 3, the space velocities were reduced to 0.91 $HR^{-1}$ and 0.63 $HR^{-1}$ respectively. Reactor 4 experienced a temperature exotherm in Run 3. That is, the inlet temperature was 890° F. and outlet temperature was 902° F. for a 12 degree increase in temperature. Thus, the reaction became exothermic where typically the reforming operation was endothermic in each reactor, normally showing a temperature decrease from inlet to outlet of each reactor.

Analysis of the products of the naphtha reforming Runs 1, 2, and 3 is given in Table II-B:

TABLE II-B

| Conditions/Test | 1 | 2 | 3 |
|---|---|---|---|
| WAIT, °F.(1) | 888 | 888 | 891 |
| LHSV | 1.55 | 0.91 | 0.63 |
| $H_2$/HC, mols | 3.89 | 3.92 | 5.2 |
| PSIG, #1 inlet | 433 | 432 | 430 |
| ΔPSI | 24 | 19 | 15 |
| Total ΔT, °F. | 163 | 125 | 61 |
| Recycle | | | |
| $H_2O$ ppmw(2) | 4.0 | 3.4 | 3.8 |
| HCl ppmw | 0.11 | 0.21 | 0.09 |
| Feed $H_2O$, ppmw | 0.25 | 0.20 | 0.20 |
| Test Time, Hrs | 9 | 16 | 16 |
| Yields Wt % Feed | | | |
| $H_2$ | 1.32 | 1.24 | 0.81 |
| $C_1$ | 1.34 | 1.95 | 1.88 |
| $C_2$ | 1.36 | 2.04 | 2.85 |
| $C_3$ | 1.79 | 2.46 | 4.58 |
| $C_4$= | 0.01 | 0.01 | 0.02 |
| $iC_4$ | 0.94 | 1.25 | 2.37 |
| $nC_4$ | 1.70 | 2.07 | 3.73 |
| $nC_5$= | 0.19 | 0.28 | 0.46 |
| $iC_5$ | 2.04 | 2.47 | 4.32 |
| $nC_5$ | 1.40 | 1.71 | 2.92 |
| $C_6$+ | 87.90 | 84.51 | 76.01 |
| Yields, % Feed | | | |
| $C_5$+, Wt | 91.53 | 88.97 | 83.71 |
| $C_5$+, Vol | 87.57 | 84.50 | 79.11 |
| $C_6$ + paraffin, vol | 22.01 | 15.66 | 12.18 |
| Stabilized product (reformate) | | | |
| RON, clear | 93.1 | 97.6 | 100.5 |
| Sp. gr. 60/60 | 0.8022 | 0.8086 | 0.8086 |

(1)WAIT = Weighted Average Initial Temperature, °F.
(2)ppmw = parts per million by weight.

Observation of the yields of light hydrocarbons, such as methane ($C_1$), ethane ($C_2$), and propane ($C_3$), shows increased values as the space velocity was reduced. This is indicative of hydrocracking and is consistent with the exotherm experienced in Reactor 4 of Run 3 of Table II.

These experimental results showed that indeed the lower space velocity of Run 3 did induce exothermicity characteristic of hydrocracking. Thus, a means was developed by which a commercial reformer can test for malflow, channeling or by-passing within the reformer system of reactors. Specifically, on startup at normal space velocity, such as of e.g. 1.5 $H^{-1}$ $hr^{-1}$, the space velocity is deliberately reduced until an incipient endotherm is obtained, generally in the last reactor of the train of reactors. After testing to establish where the minimum space velocity occurs that produces hydrocracking (exothermicity), the space velocity is brought back to desired operating level, typically 1.5 $HR^{-1}$ space velocity. As the run progresses, if channeling or other by-passing is suspected, the space velocity is again reduced to the point of incipient exothermicity. If this space velocity is greater than before experienced, then channeling or other by-passing is indicated.

Reasonable variations in my invention are to be expected, and should not be considered to be outside of my invention as claimed.

I claim:

1. In a process of endothermic conversion of a naphtha stream by means of a catalytic reforming process, the steps which comprise:

(a) monitoring the effluent stream temperature, monitoring the inlet feed stream temperature, and determining the difference thereof as a negative $\Delta T$; and (b) periodically reducing the inlet feed stream flow rate and observing again the $\Delta T$, wherein a change of negative $\Delta T$ to a positive $\Delta T$ indicates by-passing of the catalyst reactor bed.

2. The process of claim 1 employing a naphtha selected from straight run and cracked naphtha and boiling in the range of about 120° F. to 400° F.

3. The process of claim 2 employing a feed inlet temperature of about 800° F. to 1000° F., a product stream outlet temperature of about 700° F. to 1000° F., such that $\Delta T$ is about 0° F. to −400° F.

4. The process of claim 3 employing a liquid hourly space velocity of about 0.7 to 3 Bbl charge per Bbl catalyst per hour; a hydrogen/naphtha molar ratio of about 2 to 8 mols/mol; and a pressure of about 50 to 500 psig.

5. The process of claim 4 wherein said reactor means comprises a series of at least three reactors wherein the summed $\Delta T$ across the series is about −100° F. to −300° F.

6. In a process for the catalytic treatment of a hydrocarbon stream to increase at least one of the octane numbers thereof and the BTX content thereof, wherein said hydrocarbon stream as a feed stream at an effective input flow rate is preheated to a first temperature, said preheated feed stream is contacted with a catalyst at effective reaction temperatures and pressures in at least one reactor means, thereby producing a product stream at a second temperature, wherein said contacting results in a normally endothermic balance of reactions such that the difference between said first temperature and said second temperature is negative under normal operation, and positive under conditions indicating catalyst by-passing, a procedure to determine said by-passing which comprises:

(a) comparing said first and second temperatures at said effective input flow rate under endothermic reaction conditions, (b) reducing said input flow rate by about 20 to 40 volume percent, (c) again determining at said reduced flow rate said inlet temperature and said outlet temperature and the difference therebetween, and (d) where said difference is positive, said positive difference indicates catalyst by-passing.

7. The process of claim 6 employing a naphtha selected from straight run and cracked naphtha and boiling in the range of about 120° F. to 400° F.

8. The process of claim 7 employing a feed inlet temperature of about 800° F. to 1000° F., a product stream outlet temperature of about 700° F. to 1000° F., such that $\Delta T$ is about 0° F. to −400° F.

9. The process of claim 8 employing a liquid hourly space velocity of about 0.7 to 3 Bbl charge per Bbl catalyst per hour; a hydrogen/naphtha molar ratio of about 2 to 8 mols/mol; and a pressure of about 50 to 500 psig.

10. The process of claim 9 wherein said reactor means comprises a series of at least three reactor means wherein the summed $\Delta T$ across the series is about −100° F. to −300° F.

11. In a normally endothermic naphtha reformer reactor means employing a particulate fixed bed of catalyst, and a naphtha feed thereto at a first feedrate, to determine occurrance of by-passing of said particulate catalyst by said naphtha, decreasing the feedrate to the reactor by about 20 to 40 volume percent to a second feedrate, and if the reactor outlet stream temperature thereupon exceeds the reactor inlet feed stream temperature, catalyst by-passing is occurring, provided on earlier testing at such second feedrate such exotherm was not evident.

12. The process of claim 11 employing a naphtha selected from straight run and cracked naphtha and boiling in the range of about 120° F. to 400° F.

13. The process of claim 12 employing a feed inlet temperature of about 800° F. to 1000° F., a product stream outlet temperature of about 700° F. to 1000° F., such that $\Delta T$ is about 0° F. to −400° F.

14. The process of claim 13 employing a liquid hourly space velocity of about 0.7 to 3 Bbl charge per Bbl catalyst per hour; a hydrogen/naphtha molar ratio of about 2 to 8 mols/mol; and a pressure of about 50 to 500 psig.

15. The process of claim 14 wherein said reactor means comprises a series of at least three reactor means wherein the summed $\Delta T$ across the series is about −100° F. to −300° F.

* * * * *